US005123263A

United States Patent [19]

Gustafson

[11] Patent Number: 5,123,263

[45] Date of Patent: Jun. 23, 1992

[54] REFRIGERATION SYSTEM

[75] Inventor: Alan D. Gustafson, Eden Prairie, Minn.

[73] Assignee: Thermo King Corporation, Minneapolis, Minn.

[21] Appl. No.: 726,087

[22] Filed: Jul. 5, 1991

[51] Int. Cl.[5] ..... F25B 41/06

[52] U.S. Cl. ..... 62/511; 62/525; 165/174

[58] Field of Search ..... 165/174; 62/511, 525, 62/527

[56] References Cited

U.S. PATENT DOCUMENTS

| | | | |
|---|---|---|---|
| 1,824,527 | 9/1931 | Bach . | |
| 1,974,876 | 9/1934 | Schack | 165/174 |
| 2,332,981 | 10/1943 | Anderson | 165/38 |
| 2,614,394 | 10/1952 | McGrath | 62/3 |
| 2,650,799 | 9/1953 | Fritzberg | 165/174 |
| 2,707,868 | 5/1955 | Goodman | 62/527 |
| 3,204,663 | 9/1965 | Taylor | 62/511 |
| 3,559,729 | 2/1971 | Radebold | 165/174 |
| 3,864,938 | 2/1975 | Hayes, Jr. | 62/511 |
| 4,202,182 | 5/1980 | Kawashima et al. | 62/511 |
| 4,277,953 | 7/1981 | Kramer | 62/117 |
| 4,899,549 | 2/1990 | Berge et al. | 62/160 |

FOREIGN PATENT DOCUMENTS 52255 4/1977 Japan .

*Primary Examiner*—Ronald C. Capossela
*Attorney, Agent, or Firm*—D. R. Lackey

[57] ABSTRACT

A refrigeration distribution arrangement which improves the uniformity of coil temperature distribution along the length of an evaporator coil. The distribution arrangement is particularly beneficial when an evaporator coil is operating partially flooded with refrigerant, such as when refrigeration capacity is being reduced with a suction line modulation valve. Distributor tubes from a refrigerant distributor are inserted for at least first and second different dimensions into coil tubes which initiate a plurality of refrigerant circuits in the evaporator coil. In an exemplary embodiment, the first dimension is a relatively short dimension, and the second dimension is a relatively long dimension, such as about one-third of the coil length. The refrigerant thus expands at different locations across the coil length, initiating coil cooling at different coil locations. The discharge temperature of air (flowing across the evaporator coil into a served space is thus more uniform across the coil length.

4 Claims, 4 Drawing Sheets

REFRIGERATION SYSTEM

TECHNICAL FIELD

The invention relates in general to refrigeration systems, and more specifically to refrigerant distribution techniques in refrigeration systems.

BACKGROUND ART

When the evaporator coil of a refrigeration system is operating at or near full load, the evaporator coil is almost fully flooded with refrigerant. When the evaporator coil is almost fully flooded, the temperature of the coil across its length will be very uniform, and thus air flowing across the evaporator coil will have a uniform discharge temperature across the coil length. This is very important in transport refrigeration systems, as perishables have a shelf life dependent upon the ability of the transport refrigeration system to maintain a desired set point temperature. Only a few degrees temperature difference may deleteriously affect the shelf life of a perishable product in the cargo space of a truck, trailer, container, and the like.

In an effort to maintain the temperature of the served cargo space as closely as possible to set point, and thus obtain the shelf life advantage, suction line modulation is being increasingly used by refrigeration system control algorithms to reduce the mass flow of refrigerant when the sensed temperature is close to the predetermined set point temperature For example, U.S. Pat. No. 4,899,549, which is assigned to the same assignee as the present application, discloses a transport refrigeration system which has a suction line modulation valve, with the associated refrigeration control providing suction line modulation in cooling and heating cycles above and below set point, respectively.

While suction line modulation enables a sensed temperature to be held closer to set point, controlling the cooling capacity of a refrigeration system by reducing the refrigerant mass flow may result in only a small portion of the evaporator coil being flooded with refrigerant when extensive capacity reduction is required. As a result, the air temperature along the length of the evaporator coil may not be uniform, i.e., the evaporator coil will be colder at the refrigerant distribution end of the evaporator coil than at the opposite end.

Accordingly, it would be desirable, and it is an object of the invention, to be able to provide a more uniform temperature of air flow across, i.e., transverse to, the length dimension of an evaporator coil, especially with refrigeration systems which may only partially flood an evaporator coil with refrigerant during their operation, such as those which utilize suction line modulation to reduce cooling and heating capacity near set point.

SUMMARY OF THE INVENTION

Briefly, the present invention is a refrigeration system which includes a refrigerant circuit having an evaporator coil defined by predetermined length and width dimensions, with the length dimension being terminated by first and second longitudinal ends. Air delivery means in the form of fans or blowers draw air from a served space, pass it over the evaporator coil, and return the conditioned air to the served space.

The evaporator coil has a plurality of parallel refrigerant circuits. Each refrigerant circuit is initiated by a coil tube having an opening at the first longitudinal end of the evaporator coil, with the coil tube extending to the second longitudinal end of the evaporator coil. A refrigerant distributor is provided which has an inlet, and a plurality of outlets defined by a plurality of distributor tubes. The distributor tubes extend into the openings of the refrigerant circuit initiating coil tubes for at least first and second different predetermined dimensions. The refrigerant is thus expanded at different locations across the length of the evaporator coil, providing a more uniform cooling of the evaporator coil across its length, even when the refrigeration system control is providing a large reduction in refrigeration capacity. With a more uniform coil temperature, the air flowing across the evaporator coil will also have a more uniform temperature, measured from one end of the coil to the other.

In a preferred embodiment of the invention, the plurality of refrigerant circuits are laterally spaced apart along the width dimension of the evaporator coil, with the distributor tubes which extend into their associated coil tubes for the first predetermined dimension alternating with distributor tubes which extend into their associated hairpin tubes for the second predetermined dimension. The first predetermined dimension is preferably a relatively short dimension, such that the ends of the distributor tubes start substantially at the first longitudinal end of the evaporator coil. The second predetermined dimension is preferably a relatively long dimension, such that the ends of the distributor tubes extend into the associated coil tubes for at least one third of the length of the evaporator coil. Of course, instead of only first and second predetermined different dimensions, a larger plurality of different dimensions may be used, as desired.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

Figure 1:
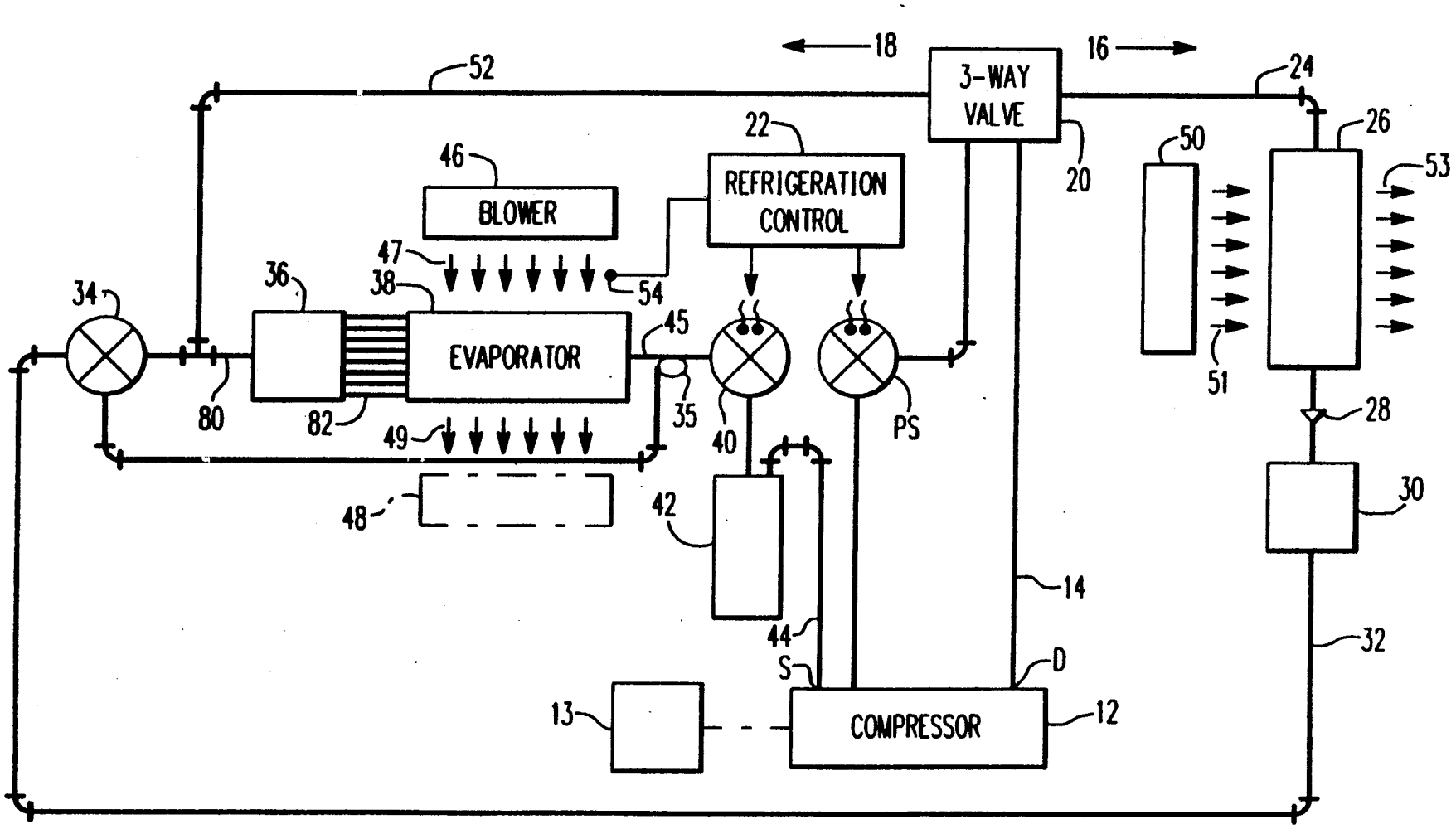
FIG. 1 is a partially block and partially schematic diagram of a refrigeration system which may be constructed according to the teachings of the invention.

Referring now to the drawings, and to FIG. 1 in particular, there is shown in schematic form a refrigeration system 10, such as the transport refrigeration system set forth in the hereinbefore mentioned U.S. Pat. No. 4,899,549. Refrigeration system 10 includes a compressor 12 driven by a suitable prime mover 13, such as an internal combustion engine, or an electric motor. Compressor 12 includes discharge and suction ports D and S, respectively, with the discharge port D being connected to a hot gas line 14. The hot gas line 14 is connected into a selected one of first and second refrigerant circuits 16 or 18, respectively, via a circuit selecting valve arrangement, such as a three-way valve 20, as illustrated, or two separate valves. Three-way valve 20 is normally in a position which selects the first refrigerant circuit 16 A pilot solenoid valve PS, when energized by refrigeration control 22, connects valve 20 to the low pressure side of compressor 12, to cause valve 20 to switch and connect hot gas line 14 to the second refrigerant circuit 18.

The first refrigerant circuit 16 includes a hot gas line 24; a condenser 26; a check valve 28; a receiver 30; a liquid line 32; an expansion valve 34, which typically includes a thermal control bulb 35 and an equalizer line (not shown); a refrigerant distributor 36; an evaporator 38; a suction line modulation valve 40; an accumulator 42; and a suction line 44 which returns refrigerant to the suction port S of compressor 12. The control bulb 35 of the expansion valve 34 is disposed in heat exchange relation with an output line 45 of evaporator 38.

An evaporator blower or fan arrangement 46 draws air, indicated by arrows 47, from a served space 48, such as the cargo space of a truck, trailer, or container. The return air 47 is passed in heat exchange relation across evaporator coil 38, and the resulting conditioned air, indicated by arrows 49, is returned to, or discharged into, the served space 48. The first refrigerant circuit results in cooling the evaporator coil, which removes heat from the air 47, cooling the served space 48.

The heat absorbed by the refrigerant in evaporator 38 evaporates the refrigerant, and this heat is removed from the refrigerant in condenser 26, as the refrigerant changes back to a liquid state. A condenser fan or blower arrangement 50 draws ambient air, indicated by arrows 51, and forces it to flow in heat exchange relation with condenser 26, discharging the heated air, indicated by arrows 53, back into the atmosphere.

When the served space 48 requires heat to maintain the predetermined set point temperature, as sensed by a return air temperature sensor 54, and/or by a discharge air temperature sensor (not shown), and also when evaporator coil 38 requires defrosting, control 22 energizes pilot solenoid PS, selecting the second refrigerant circuit 18. The second refrigerant circuit includes a hot gas line 52 which is connected directly to the refrigerant distributor 36, introducing hot refrigerant gas into the evaporator coil 38. During a heating cycle, the evaporator coil 38 adds heat to the air 47, with the warmed air 49 being discharged into the served space 48. During a defrost cycle, no air is discharged into served space 48, with the hot refrigerant warming the evaporator coil to remove any frost and ice which may have built up since the last defrost operation.

Figure 2:
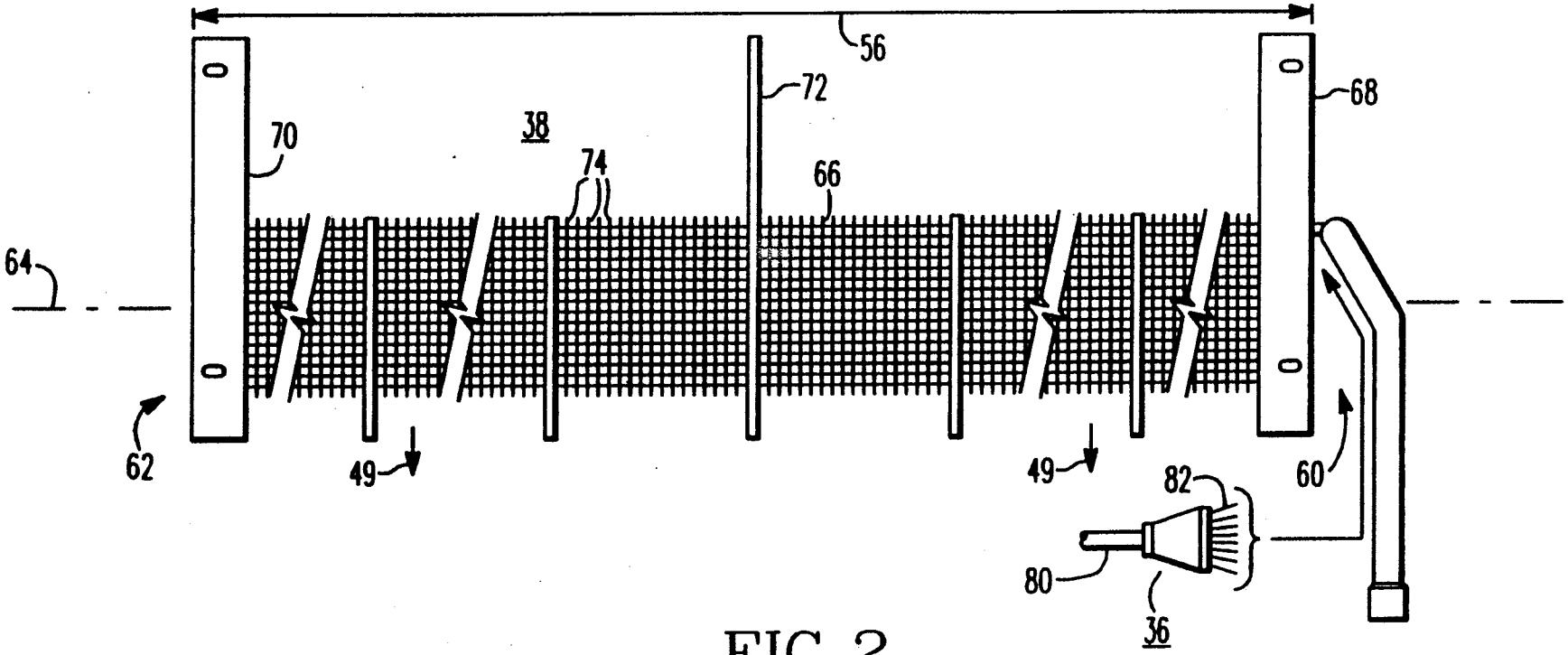
FIG. 2 is an elevational view of a typical evaporator coil construction, which may utilize the teachings of the invention.
Figure 3:
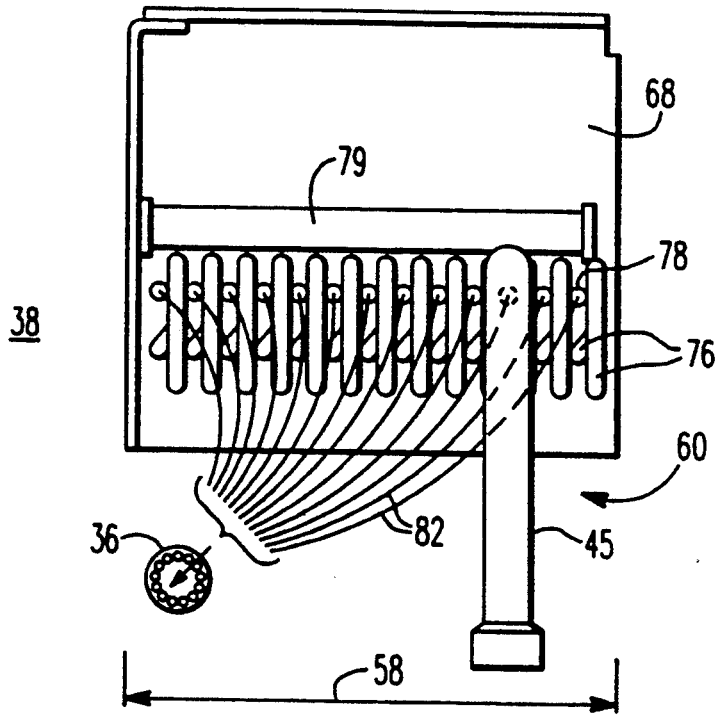
FIG. 3 is an end elevational view of the evaporator coil shown in FIG. 2.

FIG. 2 is an elevational view of evaporator coil 38 and distributor 36, and FIG. 3 is a right-hand end elevational view, when viewing FIG. 2. Evaporator coil 38 is an elongated structure, having a length dimension indicated at 56 in FIG. 2, and a width dimension indicated at 58 in FIG. 3. Evaporator coil 38 has first and second longitudinal ends 60 and 62, respectively, and a longitudinal axis 64 which extends between its ends. Evaporator coil 38 has a plurality of metallic coil tubes 66 which extend between ends 60 and 62, with the coil tubes 66, which may be hairpin tubes, being supported by first and second end header plates 68 and 70, respectively, and a center header plate 72. The coil tubes 66, which are disposed in heat exchange relation with a plurality of metallic fins 74, are divided into a plurality of separate parallel refrigerant circuits, such as 13 in the example illustrated in FIGS. 2 and 3. Each refrigerant circuit, which may be constructed of a plurality of coil tubes 66 interconnected by end bends 76, includes a refrigerant circuit initiating coil tube 66 having ends defining inlet openings at the first longitudinal end 60 of evaporator coil 38, such as the tube ends indicated at 78 in FIG. 3. The plurality of refrigerant circuits are laterally spaced across the width dimension 58 of the evaporator coil 38. Each of the refrigerant circuits has a refrigerant circuit terminating tube 66 which discharges into a suction header 79, which in turn is connected to the evaporator output line 45.

The refrigerant distributor 36 has a single metallic inlet line 80 and a plurality of metallic distributor tubes 82, e.g., one for each of the 13 refrigerant circuits of the exemplary embodiment. As illustrated in FIG. 3, each of the distributor tubes 82 extends into an opening defined by the ends 78 of the refrigerant circuit initiating tubes 66, with solder joints 84, shown in FIGS. 4, 5 and 6, sealing the opening at ends 78. In the prior art, as illustrated in FIGS. 4 and 5, the ends 86 of the distributor tubes 82 extend for a like short dimension into the openings defined by the coil tube ends 78, with this predetermined dimension being just long enough to insure that good solder joints 84 may be achieved between the two tubes 66 and 82.

Figure 4:
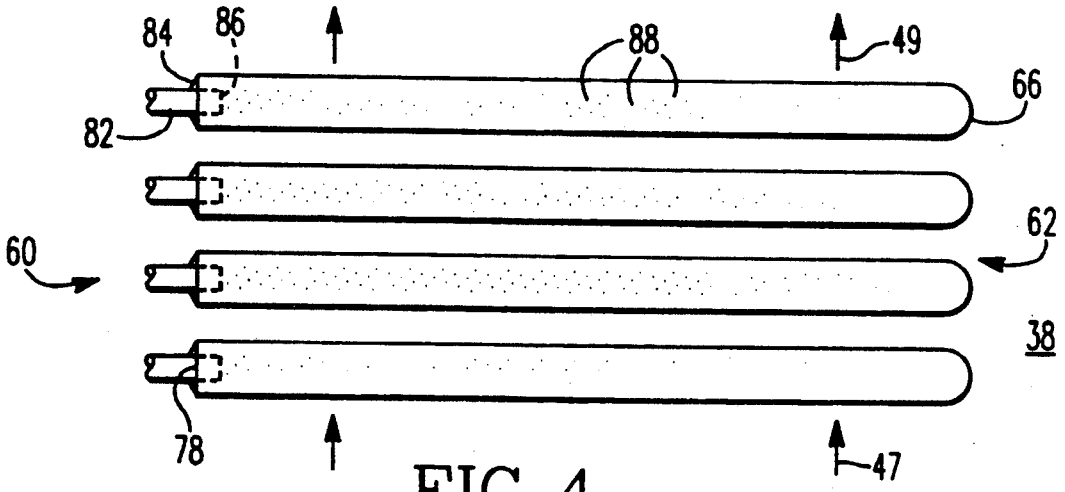
FIG. 4 is a fragmentary plan view of a plurality of evaporator coil circuits, illustrating almost complete flooding of the circuits with refrigerant, such as when the evaporator coil is substantially fully loaded.
Figure 5:
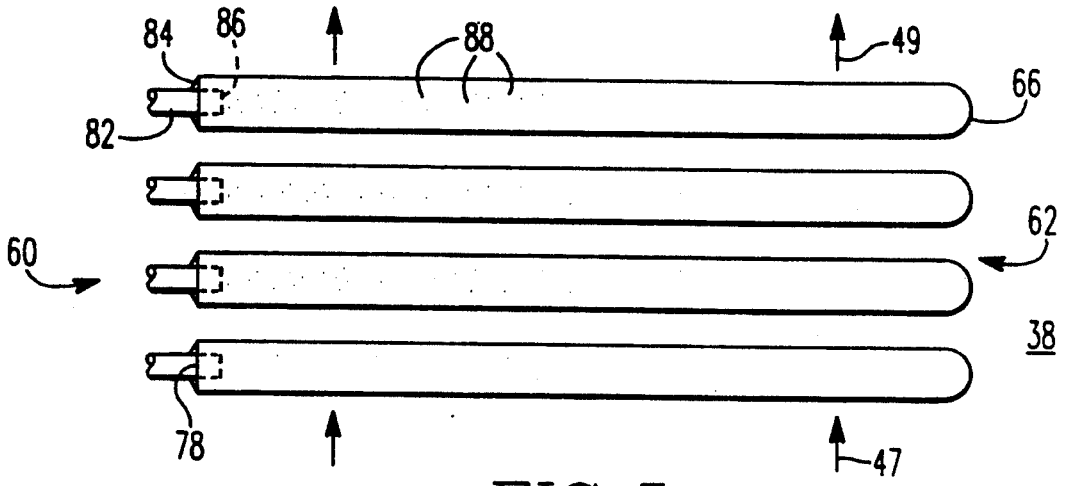
FIG. 5 is a fragmentary plan view of a plurality of evaporator coil circuits, similar to FIG. 4, except illustrating the partial flooding which occurs when the refrigerant capacity is reduced, such as by reducing the mass flow of refrigerant with a suction line modulation valve.
Figure 6:
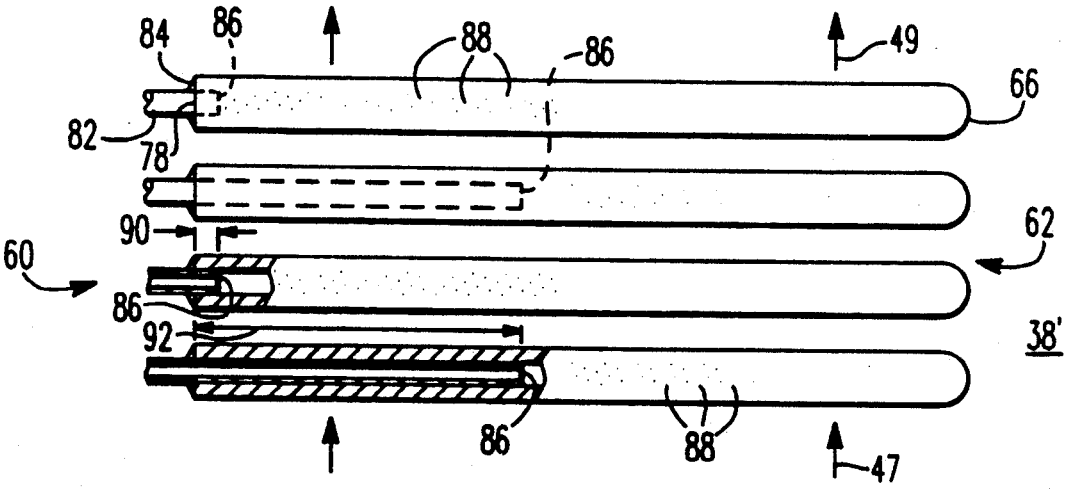
FIG. 6 is a fragmentary plan view of a plurality of evaporator coil circuits, illustrating partial flooding similar to FIG. 5, except with an evaporator coil constructed according to the teachings of the invention.

FIGS. 4, 5 and 6 are fragmentary plan views which illustrate the refrigerant circuit initiating coil tubes 66 of the first four refrigerant circuits of evaporator coil 38.

FIG. 4 illustrates evaporator coil 38 when refrigeration system 10 is operating at or near full capacity. When refrigeration system 10 is operating at or near full load, with modulation valve 40 wide open, evaporator coil 38 is almost fully flooded with refrigerant 88, with the refrigerant 88 being illustrated in FIGS. 4, 5 and 6 with the plurality of small dots. It will be noted that in FIG. 4 the refrigerant 88 extends completely across the length of the coil tubes 66, from the first longitudinal end 60 of evaporator coil 38 to the second longitudinal end 62. This condition uniformly cools evaporator coil 38 from end to end, and the temperature of the discharge air 49 is very uniform across the coil length 56, i.e., the temperature of air 49 leaving evaporator coil 38 near its first longitudinal end is substantially the same as the temperature of air 49 leaving evaporator coil 38 near its second longitudinal end.

When modulation valve 40 is operated by refrigeration control 22 to reduce the mass flow of refrigerant when the temperature of the served space 48, such as sensed by the return air temperature sensor 54, is near set point, only a small portion of evaporator coil 38 may be flooded with refrigerant 88, as indicated in FIG. 5. The evaporator coil 38 will then be colder at the first longitudinal end 60, where the distributor tubes 82 introduce refrigerant into the evaporator coil 38, than at the second end, and the discharge air 49 leaving evaporator coil 38 will have a similar non-uniform temperature across the coil length 56. In other words, the discharge air 49 will be colder near the first longitudinal end than near the second longitudinal end.

The present invention improves the evaporator coil temperature uniformity across its length 56, and thus the air temperature is more uniform from one end of the evaporator coil 38 to the other, by extending some of the distributor tubes 82 further into the coil tubes 66 than others. The inside diameter (ID) of the distributor tubes 82 is much less than the ID of the coil tubes 66, preventing any significant expansion of the refrigerant 88 until it reaches the end 86 of the distributor tube. Thus, the cooling effect of the refrigerant 88 starts at the ends 86 of the plurality of distributor tubes 82. By varying the location of the ends 86 along the length 56 of evaporator coil 38, the condition illustrated in FIG. 6 may be obtained, wherein some of the coil tubes 66 are flooded with refrigerant 88 starting at longitudinal end 60 of evaporator coil 38 and extending to approximately the center of the coil 38, and the remaining coil tubes 66 are flooded with refrigerant 88 starting near the center of coil 38 and extending to the second longitudinal end 62. Thus, the discharge air 49 will have a substantially uniform temperature along the entire length 56 of the evaporator coil 38.

In verifing the benefit of the distributor tube arrangement shown in FIG. 6, an evaporator coil 38 having a length dimension of 64 inches (1625 mm) and a width dimension of 13.4 inches (340 mm) was constructed of hairpin coil tubes 66 having a tube outside diameter (OD) of 0.375 inch (9.5 mm), with a wall thickness of 0.016 inch (0.406 mm). Thirteen parallel refrigerant circuits were used, as in the exemplary embodiment, with 6 coil tubes per circuit. A total of 376 fins 74 were used, providing a density of six fins per inch (2.4 fins per cm). The distributor tubes 82 had an OD of 0.1875 inch (4.76 mm) and a wall thickness of 0.030 inch (0.76 mm). Thus, the ID of the coil tubes 66 has about 7.5 times greater cross sectional flow area than the distributor tubes 82.

The ends 86 of the distributor tubes 82 were inserted into the ends 78 of the coil tubes 66 for first and second predetermined dimensions, indicated at 90 and 92 in FIG. 6. The first predetermined dimension 90 was just long enough to insure a good solder joint 84, such as about 1 inch (25.4 mm), and the second predetermined dimension was 20 inches (508 mm). The first and second predetermined dimensions 90 and 92 were alternated across the coil width 58, with the odd numbered circuits 1, 3, 5, 7, 9, 11 and 13 having the first dimension 90 and the even numbered circuits 2, 4, 6, 8, 10 and 12 having the second dimension 92.

An evaporator coil was also constructed according to the teachings of the prior art, as illustrated in FIGS. 4 and 5, wherein the first dimension 90 was used for all distributor tube insertions. Except for this change, the two evaporator coils were of like construction. Operating each evaporator coil under the same mass flows, with the modulation valve 40 restricting the mass flow to the same extent, provided a temperature differential across the coil length 56 of 3 degrees F. (1.67 degrees C.) using the prior art construction, while the evaporator coil constructed according to the teachings of the invention had a temperature differential across the coil length 56 of only 1.5 degrees F. (0.83 degrees C.), a temperature distribution improvement of 50%. This is a very significant improvement, especially in transport refrigeration systems which must closely maintain predetermined set point temperatures in their cargo spaces, to preserve and increase the shelf life of perishable products, such as foods and flowers.

The invention automatically provides a more uniform temperature across the evaporator coil as the load on the evaporator coil drops, without requiring any additional electrical control, any additional distributors, any additional solenoid valves, and without requiring any additional tapping of refrigerant circuits. In addition to achieving the hereinbefore described advantages without any additional hardware or control, the invention adds insignificantly to the manufacturing time or cost, as the soldering operation between the hairpin tubes and distributor tubes is the same as utilized in prior art evaporator coil construction. The fact that first portion of some refrigerant circuits, i.e., the circuits in which the distributor tubes 82 are inserted in the coil tubes 66 for the greater distance 92, insignificantly affects operation of the evaporator coil at higher loads, as each refrigerant circuit has a plurality of coil tubes 66. Thus, air temperature uniformity is not deleteriously affected at higher loads, and the reduction in capacity of the evaporator coil 38 is slight, e.g., less than 3% in the example in which each refrigerant circuit has six coil tubes.

I claim:

1. A refrigeration system having a refrigerant circuit which includes an evaporator coil having predetermined length and width dimensions, with the length dimension being defined by first and second longitudinal ends, a plurality of refrigerant circuits through the evaporator coil, with each refrigerant circuit being initiated by a coil tube having an opening at the first longitudinal end, and extending to the second longitudinal end, a refrigerant distributor having an inlet and a plurality of outlets, with the outlets being defined by a plurality of distributor tubes which extend into the openings of the refrigerant circuit initiating coil tubes, and means providing air flow across the evaporator coil, characterized by:

said distributor tubes extending into the openings of the coil tubes for at least first and second substantially different predetermined dimensions, to expand the refrigerant at different locations across the length dimension of the evaporator coil, to provide a more uniform cooling of the evaporator coil across its length during a reduction in refrigeration capacity, and a more uniform temperature of air flowing across the evaporator coil.

2. The refrigeration system of claim 1 wherein the plurality of refrigerant circuits are spaced apart along the width dimension of the evaporator coil, with distributor tubes which extend into the associated coil tubes for the first predetermined dimension alternating with distributor tubes which extend into the associated coil tubes for the second predetermined dimension.

3. The refrigeration system of claim 1 wherein the first predetermined dimension results in the ends of the distributor tubes being substantially at the first longitudinal end of the evaporator coil, and the second predetermined dimension results in the ends of the distributor tubes being at least one third of the way across length dimension the evaporator coil.

4. The refrigeration system of claim 1 wherein the refrigerant circuit includes a suction line modulation valve for reducing refrigerant capacity at light loads.

* * * * *